US006915555B2

(12) United States Patent
Ajiki

(10) Patent No.: US 6,915,555 B2
(45) Date of Patent: Jul. 12, 2005

(54) METHOD FOR MANUFACTURING SPEAKER

(75) Inventor: Kenichi Ajiki, Mie (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 246 days.

(21) Appl. No.: 10/181,033

(22) PCT Filed: Nov. 13, 2001

(86) PCT No.: PCT/JP01/09906

§ 371 (c)(1),
(2), (4) Date: Oct. 22, 2002

(87) PCT Pub. No.: WO02/41667

PCT Pub. Date: May 23, 2002

(65) Prior Publication Data

US 2003/0093891 A1 May 22, 2003

(30) Foreign Application Priority Data

Nov. 15, 2000 (JP) ..... 2000-347799

(51) Int. Cl.[7] ..... H04R 31/00

(52) U.S. Cl. ..... 29/594; 29/592.1; 29/609.1; 156/73.1; 156/250; 261/65; 264/212; 264/216; 264/320; 264/323; 264/331; 228/181; 228/190; 381/113; 381/116; 381/174; 381/191

(58) Field of Search ..... 29/592.1, 594, 29/609.1; 156/73.1, 250, 267, 292, 293; 261/65; 264/212, 216, 320, 323, 331; 228/181, 190; 381/113, 116, 174, 191

(56) References Cited

U.S. PATENT DOCUMENTS 5,715,324 A * 2/1998 Tanabe et al. ..... 381/412
5,757,945 A * 5/1998 Sakamoto ..... 381/400
6,248,400 B1 * 6/2001 Kurihara et al. ..... 427/249.8

FOREIGN PATENT DOCUMENTS

JP 61-273099 12/1986
JP 5-236591 9/1993
JP 09084185 A * 3/1997 ..... H04R/9/02

OTHER PUBLICATIONS

"A high fidelity small–sized loudspeaker"; Satoh, K.; Takewa, H.; Iwasa, M.; Kikkawa, T.; Consumer Electronics, IEEE Transactions on, vol.: 43, Issue: 3, Aug. 1997; pp.: 972–979.*

* cited by examiner

*Primary Examiner*—Paul Kim
(74) *Attorney, Agent, or Firm*—Wenderoth, Lind & Ponack, L.L.P.

(57) ABSTRACT

A method of manufacturing a loudspeaker comprises: continuously forming diaphragm portions and alignment portions on a band resin film; positioning one of a frame and a protector at an upper die or lower die; aligning other alignment portions formed on the frame, the protector, or the upper or lower die having the film disposed thereon, with the alignment portion formed on the film; bonding the frame and the resin film that is to form the diaphragm; and cutting a diaphragm out of the resin film. A position of bonding the diaphragm to the frame or the protector can be easily determined by aligning the alignment portion formed on the band resin film with another alignment portion provided on the frame, the protector, or the lower or upper die on which the frame or protector is disposed. Further, a conventionally-indispensable ring can be eliminated to reduce a number of components.

21 Claims, 7 Drawing Sheets

METHOD FOR MANUFACTURING SPEAKER

This application is a National Stage application of PCT/JP01/09906, filed Nov. 13, 2001.

TECHNICAL FIELD

The present invention relates to a method of manufacturing small-sized speakers used in mobile communication equipment and the like.

BACKGROUND ART

A conventional method of manufacturing a loudspeaker (speaker) will be described with reference to FIG. 7 to FIG. 9 by taking a receiver as an example, which is a type of speaker used in mobile communication equipment.

FIG. 7 is a half sectional view of a conventional receiver, FIG. 8 is an exploded perspective view of the same, and FIG. 9 is a manufacturing flow sheet of the same. In FIG. 7 to FIG. 9, the receiver comprises frame 1, yoke 2 bonded to the frame 1, magnet 3 bonded to an internal center of the yoke 2, plate 4 bonded to a top of the magnet 3, voice coil 5 bonded to diaphragm 6, ring 7 bonded to the frame 1 after being bonded to a periphery of the diaphragm 6, protector 8 for protecting the diaphragm 6, and lead wire junction 9 of the voice coil 5 formed in the frame 1. The yoke 2, the magnet 3, and the plate 4 form a magnetic circuit.

The method of manufacturing the receiver is described in the following. A receiver manufacturing method generally comprises: a molding process for molding diaphragm 6 out of band resin film by use of a die; a periphery cutting process for cutting a periphery of the diaphragm 6 by use of a high precision cutting die; a ring bonding process for bonding ring 7 to the periphery of diaphragm 6; a first bonding process for bonding the voice coil 5 and the diaphragm 6; an insert molding process for molding a junction component integrated by insert-molding of a magnetic circuit portion formed of the yoke 2, the magnet 3 and the plate 4 into the frame 1 made of resin; a second bonding process for bonding the frame 1 and the junction component by arranging the voice coil 5 in a magnetic gap of the magnetic circuit portion; a soldering process for soldering lead wires of the voice coil 5 to the lead wire junction 9 of the frame 1; and a third bonding process for bonding the protector 8.

However, in the above conventional manufacturing process, the ring 7 is bonded to the periphery of the diaphragm 6 during the ring bonding process, resulting in an increase in a number of components used and man-hours required for assembly. Accordingly, there arises a problem of high manufacturing costs. Particularly, when the diaphragm 6 is 10 $\mu$m or less in thickness, the diaphragm 6 is not strong enough and it is difficult to handle the diaphragm 6 in a single unit, and the ring bonding process is indispensable to facilitate handling of the diaphragm.

The present invention is to address the above problem by providing a speaker manufacturing method which can reduce production costs of small-sized speakers such as receivers and the like.

SUMMARY OF THE INVENTION

The speaker manufacturing method of the present invention includes steps of: forming diaphragm portions and alignment portions continuously on a band resin film; disposing a frame or a protector under an upper die or on a lower die; aligning other alignment portions provided on the frame, the protector, and the upper die or the lower die relative to the alignment portion formed on the resin film; bonding the frame and resin film; and cutting a diaphragm out of the resin film.

Thus, a position of bonding the diaphragm to the frame or protector can be easily determined by aligning the other alignment portion provided on the frame, the protector or the lower or upper die with the frame or protector disposed thereon in relation to the alignment portion formed on the band resin film.

Further, it is possible to reduce the number of components used by eliminating the ring that has been conventionally indispensable. According to the present invention, as compared with the prior art, it is not difficult to handle the diaphragm despite the ring being eliminated.

Also, according to the present invention, the voice coil and the frame previously disposed on the lower die can be bonded together to the resin film with a diaphragm formed thereon, and thereby, it is possible to further reduce man-hours required for assembly.

Further, a post-process in the speaker manufacturing method of the present invention includes steps of: fixing a magnetic circuit in the frame, fixing the protector in the frame so as to cover a diaphragm or the diaphragm portion, and forming the diaphragm by cutting and separating the diaphragm portion.

According to the present invention, the protector and the magnetic circuit can be very efficiently fixed and bonded by using the band resin film as a base. By using a laser beam for performing the cutting operation, it becomes possible to perform accurate cutting with extreme ease even in a case of a diaphragm having a complicated shape such a circular, elliptical, or a racing track shape according to a contour of the diaphragm, the frame or the protector.

DETAILED DESCRIPTION OF THE PREFERRED EMBODIMENTS

Figure 1:
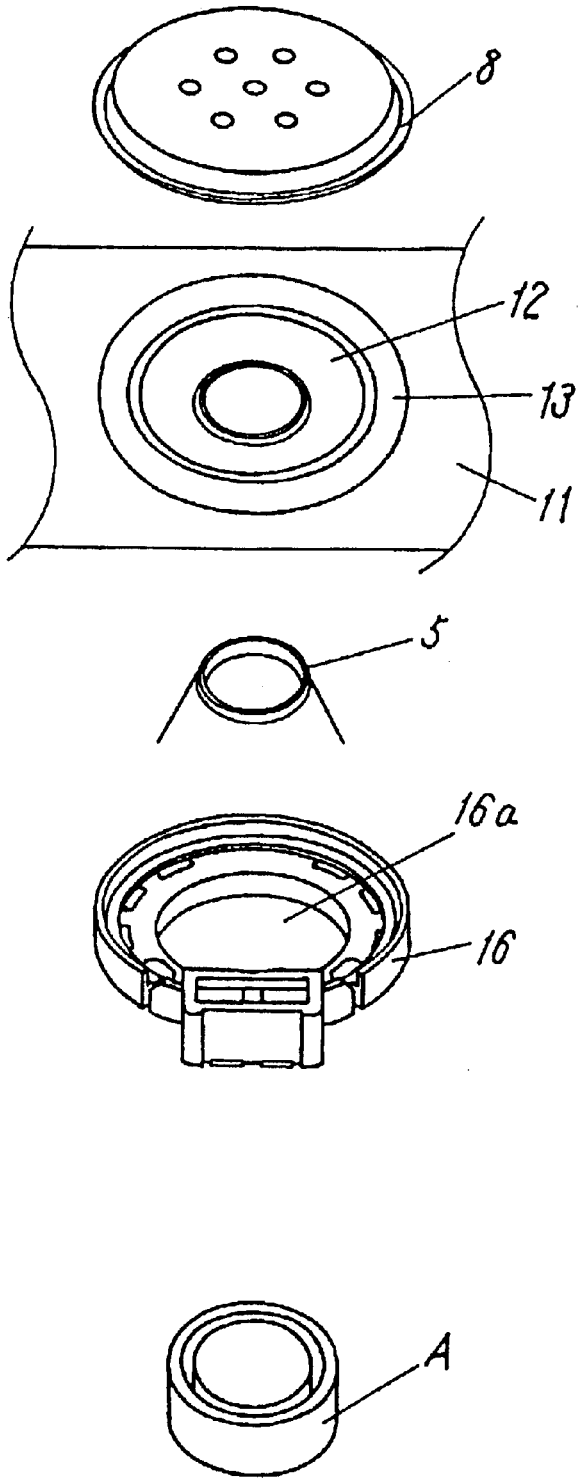
FIG. 1 is an exploded perspective view showing a receiver in one preferred embodiment of the present invention.

A speaker manufacturing method of the present invention will be described in the following with reference to FIG. 1 through FIG. 6. In this description, the same components as in the prior art are given the same reference numerals, and their description is omitted.

Figure 2:
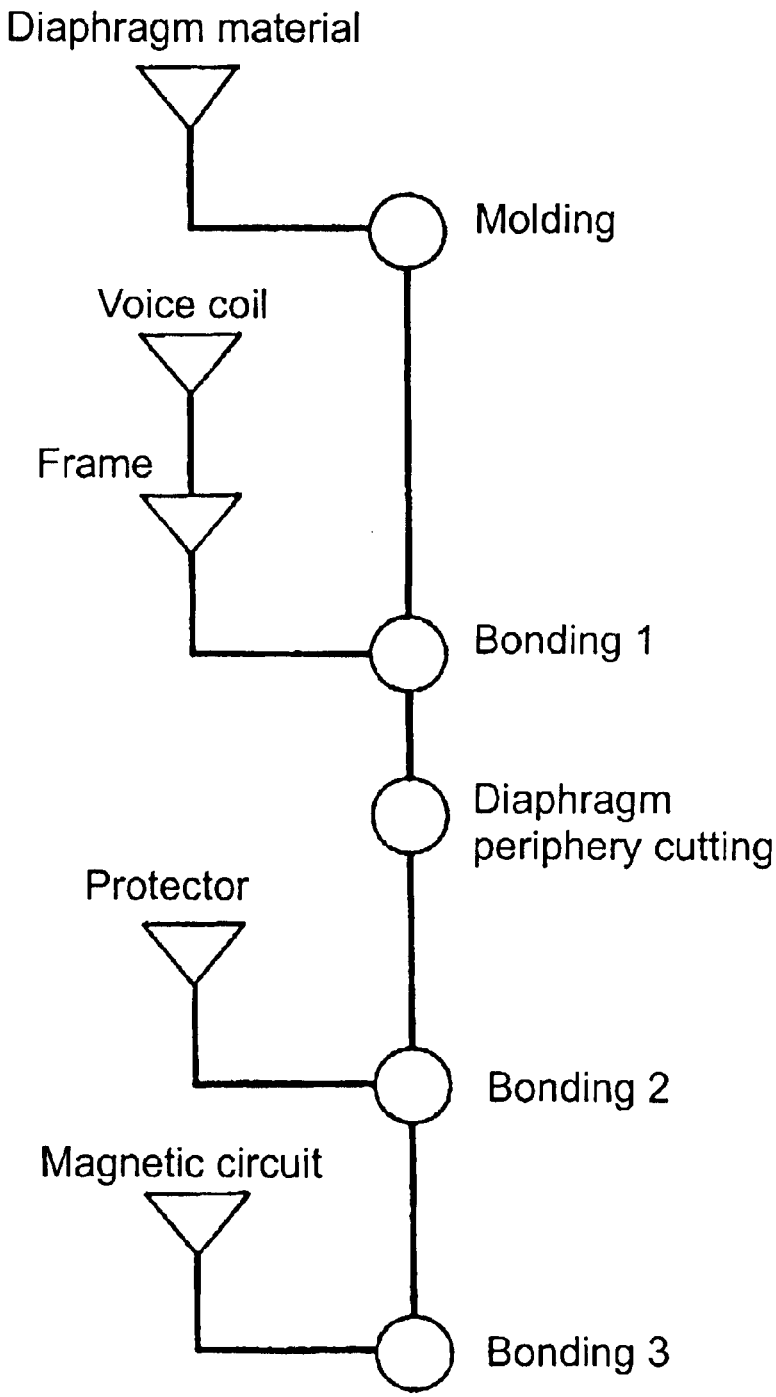
FIG. 2 is a flow sheet showing each manufacturing step in a manufacturing method of the present invention.
Figure 3:
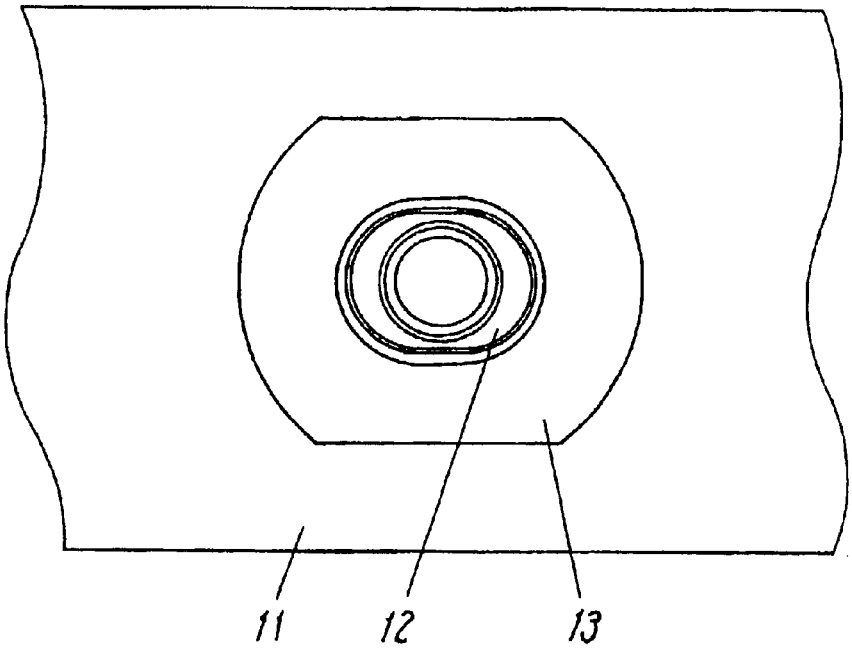
FIG. 3 is a plan view showing a state of a diaphragm formed in a band sheet.
Figure 4:
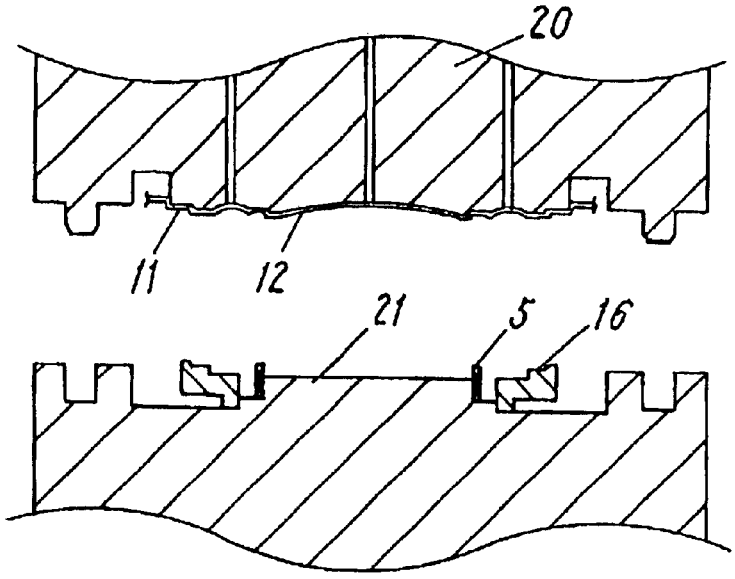
FIG. 4 is a sectional view for describing a step of bonding a diaphragm to a voice coil and a frame.
Figure 5:
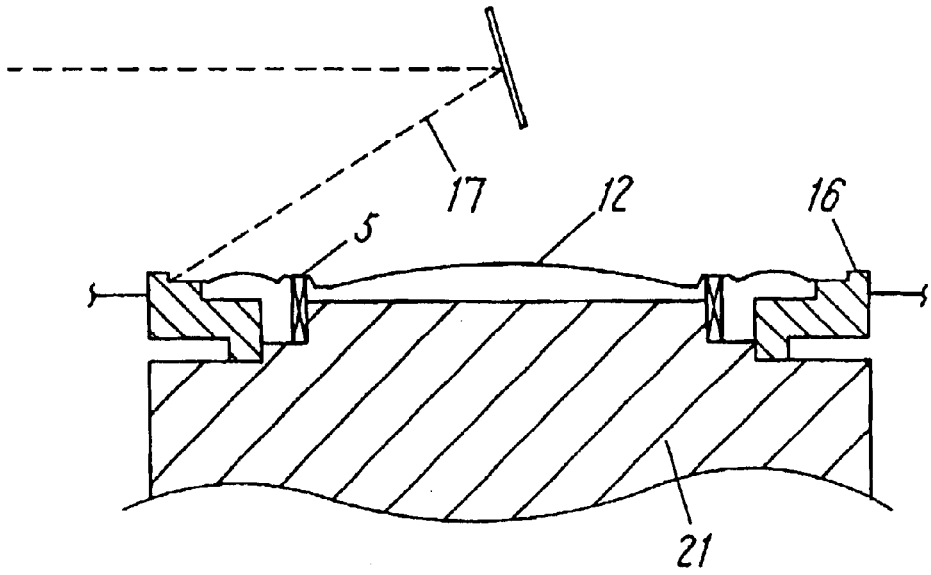
FIG. 5 is a sectional view for describing a step of cutting the diaphragm.
Figure 6:
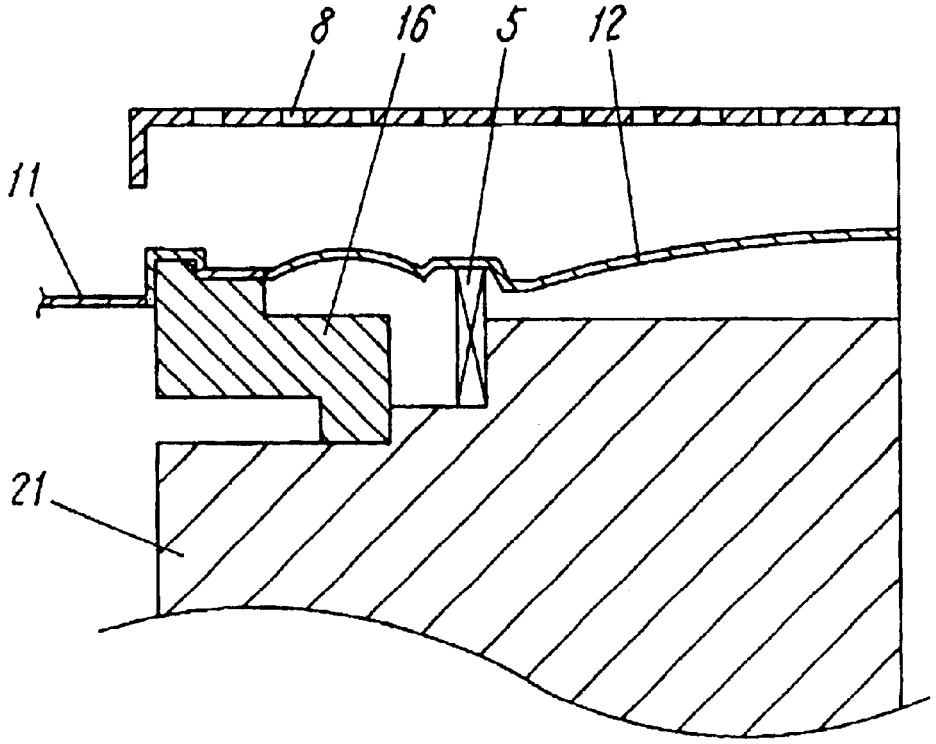
FIG. 6 is a sectional view for describing a state of a fixed protector in a modification of the one preferred embodiment.
Figure 7:
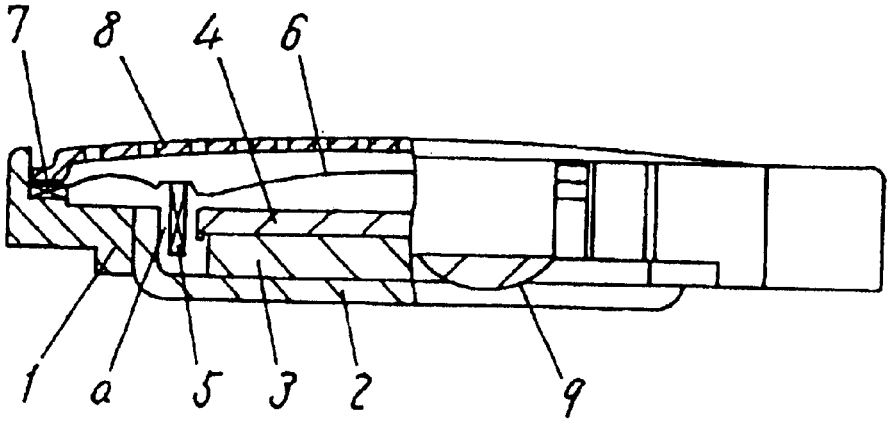
FIG.7 PRIOR ART
FIG. 7 is a half sectional front view of a conventional receiver used in a mobile communication equipment.
Figure 8:
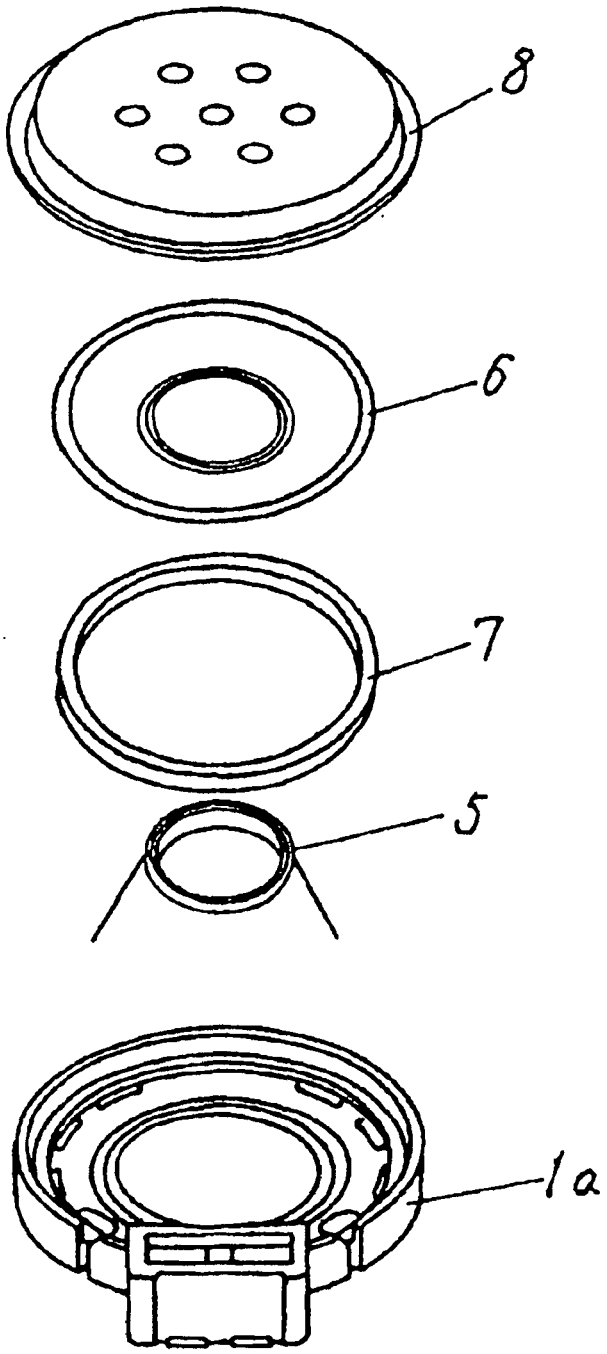
FIG.8 PRIOR ART
FIG. 8 is an exploded perspective view of the conventional receiver.
Figure 9:
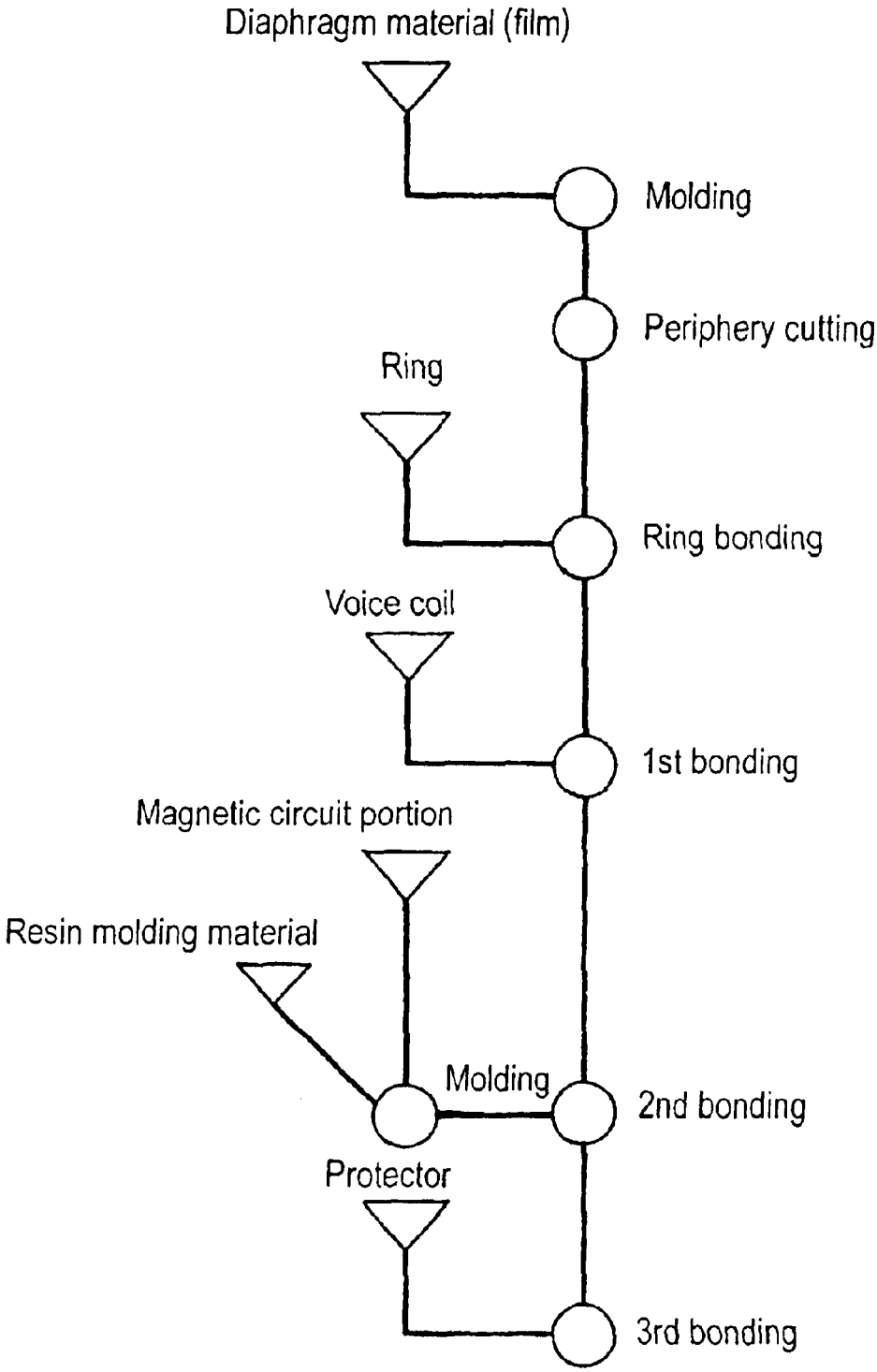
FIG.9 PRIOR ART
FIG. 9 is a flow chart of manufacturing the conventional receiver.

FIG. 1 is an exploded perspective view for describing the speaker manufacturing method in one preferred embodiment of the present invention by taking a receiver, a type of loudspeaker, as an example. FIG. 2 is a flow chart showing each manufacturing step. FIG. 3 is a plan view showing a state of a diaphragm formed on a band sheet. FIG. 4 is a sectional view for describing a step of bonding a diaphragm to a voice coil and a frame. FIG. 5 is a sectional view for describing a step of cutting the diaphragm. FIG. 6 is a sectional view for describing a state of a fixed protector, showing an example of a modification of the present preferred embodiment.

In FIG. 1, first, a band resin sheet 11 is finally cut off to form a diaphragm 6. A diaphragm portion 12 and an alignment portion 13 at a periphery of the diaphragm portion 12 are continuously molded on the band resin sheet 11 by using a molding die (molding process).

Next, as shown in FIG. 4, a voice coil 5 and a frame 16 (FIG. 1) provided with a hole portion 16*a* for fixing magnetic circuit A (FIG. 1) at a center thereof are disposed on a lower die die 21, and the band resin sheet 11 is aligned by the alignment portion 13 and attached to an upper die 20 by a vacuum.

Subsequently, an adhesive is applied to the voice coil 5 and the frame 16, and then the lower die 21 and the upper die 20 are made to contact in order to bond the voice coil 5 and the frame 16 in a predetermined position to the band resin sheet 11 (bonding process 1).

Next, as shown in FIG. 5, a periphery of the diaphragm in the band resin sheet 11 with the voice coil 5 and the frame 16 bonded thereon is cut off by a carbon dioxide laser 17 (diaphragm periphery cutting process), thereby making the diaphragm 6 into a composite unit which incorporates the voice coil 5 and the frame 16.

After that, a protector 8 is placed and bonded (bonding process 2) so as to cover the diaphragm 6 that is a composite unit, and further, magnetic circuit A is inserted into central hole 16*a* of the frame 16 and is bonded by an adhesive (bonding process 3) to complete a loudspeaker.

As described above, according to the present preferred embodiment, the alignment portion 13 is also formed when the band resin sheet 11 is formed into a diaphragm during the molding process, and the voice coil 5 and the frame 16 are bonded by using the band resin sheet 11 during the bonding process 2. In this way, it is possible to make ring 7 unnecessary which has been indispensable, and the diaphragm 6 with the voice coil 5 and the frame 16 bonded thereon can be formed by cutting the diaphragm periphery by carbon dioxide laser 17 later during the diaphragm periphery cutting process. According to the present invention, the manufacturing method is extremely easy even when the diaphragm 6 is special in shape (i.e. elliptical, of a racing track shape or the like) other than a circular shape. In addition, it brings about such an advantage in that the periphery cutting and other cutting operations can be automated in accordance with the speaker shape due to preprogrammed information.

In the description of the above preferred embodiment, the voice coil 5 and the frame 16 are bonded to the band diaphragm 11 by aligning and attaching the alignment portion 13 of band resin sheet 11 to the upper die 20 while the frame 16 and the voice coil 5 are positioned on the lower die 21 during bonding process 1. However, it is also possible that the frame 16 and the voice coil 5 are disposed on the lower die 21, and after applying adhesive thereto, the alignment portion 13 of band resin sheet 11 is alligned and press-bonded on the periphery of the frame 16 by virtue of the upper die 20. And, it is also possible to provide an alignment portion corresponding to the alignment portion 13 on the lower die 21 for convenience of performing a bonding operation.

Also, in the description of the above preferred embodiment, an example of bonding the band resin sheet 11 to the frame 16 is described, but it is also possible to bond the resin sheet 11 to the protector 8.

In the present preferred embodiment, the diaphragm periphery cutting process is described as a process performed after bonding process 1, but it is also preferable to be a process performed after bonding process 2 or a process after bonding process 3.

FIG. 6 is an example of a modification of the present preferred embodiment in which, after bonding the protector 8 to the frame 16 with adhesive, the diaphragm 6 is individually cut out of the resin sheet 11 by use of a laser beam.

In the example of this modification, the diaphragm 6 and the frame 16 can be bonded, not only by using adhesive but also by using mechanical (press-fitting) securement, to the protector 8, and as a result, a bonding reliability of the diaphragm 6 and the frame 16 is improved.

As described above, a procedure of each process of the present invention is not limited to the one adopted in the present preferred embodiment.

It is possible to properly change a procedure of other manufacturing processes so long as at least the step of molding the diaphragm portion 12 and alignment portion 13 together on band resin sheet, and the step of aligning and bonding the frame 16 by using the alignment portion 13, are included in the processes, and the procedure thereof is within the scope of the present invention.

In the above description, a manufacturing example using a continuous band resin sheet is described to improve productivity, but it should be noted that the resin sheet may be in a form of a single sheet.

Also, described in the above description is a method of bonding main component elements such as the diaphragm, the frame, and the protector with adhesive, but instead of using adhesive, these component elements may also be bonded by bonding methods such as ultrasonic welding, thermal press-bonding, and welding. That is, because most of these component elements that have been recently available are made of resin material, it is possible to employ the bonding methods as mentioned above.

INDUSTRIAL APPLICABILITY

As described above, the speaker manufacturing method of the present invention is characterized in that resin film is provided with a diaphragm portion and alignment portion, and a loudspeaker is assembled in accordance with the alignment portion without cutting a diaphragm periphery, and after assembling the speaker, peripheral cutting of the diaphragm portion is performed. According to the present invention, a ring component for holding the diaphragm can be eliminated and it is possible to reduce man-hours required for assembly and to lower manufacturing costs.

What is claimed is:

1. A method of manufacturing a loudspeaker, comprising:

forming a diaphragm portion and an alignment portion on a resin film;

forming another alignment portion on one of a frame and a protector, with said another alignment portion corresponding to said alignment portion on said resin film;

disposing one of said frame and said protector beneath an upper die or on a lower die;

aligning said another alignment portion with said alignment portion on said resin film;

using said upper die and said lower die to bond said one of said frame and said protector to said resin film; and cutting a diaphragm from said resin film, said diaphragm including said diaphragm portion.

2. The method according to claim 1, further comprising:

disposing a voice coil beneath said upper die or on said lower die; and bonding said voice coil together with said one of said frame and said protector to said resin film.

3. The method according to claim 2, wherein said one of said frame and said protector is said frame, and further comprising:

fixing a magnetic circuit, having a magnetic gap into which said voice coil is inserted, to said frame; and fixing said protector onto said frame so as to cover said diaphragm.

4. The method according to claim 2, wherein using said upper die and said lower die to bond said one of said frame and said protector to said resin film comprises using said upper die and said lower die such that bonding said one of said frame and said protector to said resin film includes one of ultrasonic welding, heat press-bonding and welding said one of said frame and said protector to said resin film.

5. The method according to claim 2, wherein forming the diaphragm portion and the alignment portion on the resin film comprises forming said diaphragm portion and said alignment portion on a continuous band of resin film.

6. The method according to claim 1, wherein said one of said frame and said protector is said frame, and further comprising:

fixing a magnetic circuit, having a magnetic gap in which a voice coil is positioned, to said frame; and fixing said protector onto said frame so as to cover said diaphragm.

7. The method according to claim 1, wherein cutting the diaphragm from said resin film comprises using a laser beam to cut said diaphragm from said resin film.

8. The method according to claim 1, wherein using said upper die and said lower die to bond said one of said frame and said protector to said resin film comprises using said upper die and said lower die such that bonding said one of said frame and said protector to said resin film includes one of ultrasonic welding, heat press-bonding and welding said one of said frame and said protector to said resin film.

9. The method according to claim 1, wherein forming the diaphragm portion and the alignment portion on the resin film comprises forming said diaphragm portion and said alignment portion on a continuous band of resin film.

10. The method according to claim 1, wherein aligning said another alignment portion with said alignment portion on said resin film comprises using said another alignment portion and said alignment portion on said resin film to align said resin film with said one of said frame and said protector.

11. The method according to claim 10, further comprising:

disposing a voice coil beneath said upper die or on said lower die; and bonding said voice coil together with said one of said frame and said protector to said resin film.

12. The method according to claim 10, wherein said one of said frame and said protector is said frame, and further comprising:

fixing a magnetic circuit, having a magnetic gap in which a voice coil is positioned, to said frame; and fixing said protector onto said frame so as to cover said diaphragm.

13. The method according to claim 10, wherein cutting the diaphragm from said resin film comprises using a laser beam to cut said diaphragm from said resin film.

14. The method according to claim 10, wherein using said upper die and said lower die to bond said one of said frame and said protector to said resin film comprises using said upper die and said lower die such that bonding said one of said frame and said protector to said resin film includes one of ultrasonic welding, heat press-bonding and welding said one of said frame and said protector to said resin film.

15. The method according to claim 10, wherein forming the diaphragm portion and the alignment portion on the resin film comprises forming said diaphragm portion and said alignment portion on a continuous band of resin film.

16. The method according to claim 1, wherein forming the diaphragm portion and the alignment portion on the resin film comprises shaping a portion of said resin film into said diaphragm portion and said alignment portion.

17. The method according to claim 16, further comprising:

disposing a voice coil beneath said upper die or on said lower die; and bonding said voice coil together with said one of said frame and said protector to said resin film.

18. The method according to claim 16, wherein said one of said frame and said protector is said frame, and further comprising:

fixing a magnetic circuit, having a magnetic gap in which a voice coil is positioned, to said frame; and fixing said protector onto said frame so as to cover said diaphragm.

19. The method according to claim 16, wherein cutting the diaphragm from said resin film comprises using a laser beam to cut said diaphragm from said resin film.

20. The method according to claim 16, wherein using said upper die and said lower die to bond said one of said frame and said protector to said resin film comprises using said upper die and said lower die such that bonding said one of said frame and said protector to said resin film includes one of ultrasonic welding, heat press-bonding and welding said one of said frame and said protector to said resin film.

21. The method according to claim 16, wherein shaping the portion of said resin film into said diaphragm portion and said alignment portion comprises shaping a portion of a continuous band of resin film into said diaphragm portion and said alignment portion.

* * * * *

UNITED STATES PATENT AND TRADEMARK OFFICE

CERTIFICATE OF CORRECTION

PATENT NO. : 6,915,555 B2
APPLICATION NO. : 10/181033
DATED : July 12, 2005
INVENTOR(S) : Kenichi Ajiki It is certified that error appears in the above-identified patent and that said Letters Patent is hereby corrected as shown below:

IN THE CLAIMS

Column 5, Claim 4, Line 19 Insert paragraph break before "using".

Claim 5, Line 26 Insert paragraph break before "forming".

Claim 7, Line 37 Insert paragraph break before "cutting".

Claim 8, Line 40 Insert paragraph break before "using".

Claim 9, Line 47 Insert paragraph break before "forming".

Column 6, Claim 21, Line 55 Insert paragraph break before "shaping".

Signed and Sealed this

Twenty-first Day of November, 2006

JON W. DUDAS
*Director of the United States Patent and Trademark Office*